US009308763B2

(12) United States Patent
Zhou et al.

(10) Patent No.: US 9,308,763 B2
(45) Date of Patent: Apr. 12, 2016

(54) RECORDING MATERIAL

(75) Inventors: Xiaoqi Zhou, San Diego, CA (US); Hongqian Wang, West Lafayette, IN (US); David Edmondson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/403,476

(22) PCT Filed: Jul. 9, 2012

(86) PCT No.: PCT/US2012/045910

§ 371 (c)(1),
(2), (4) Date: Nov. 24, 2014

(87) PCT Pub. No.: WO2014/011142

PCT Pub. Date: Jan. 16, 2014

(65) Prior Publication Data

US 2015/0165807 A1 Jun. 18, 2015

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/506* (2013.01); *B41M 5/508* (2013.01); *B41M 5/0023* (2013.01); *B41M 2205/34* (2013.01); *B41M 2205/42* (2013.01); *Y10T 428/24802* (2015.01)

(58) Field of Classification Search

CPC .... B41M 5/506; B41M 5/508; B41M 5/5218; B41M 5/0023; B41M 2205/34; B41M 2205/42; Y10T 418/24802

See application file for complete search history.

(56) References Cited

U.S. PATENT DOCUMENTS

| | | | | |
|---|---|---|---|---|
| 5,985,425 | A | 11/1999 | Tomizawa et al. | |
| 6,869,646 | B2 | 3/2005 | Deardurff et al. | |
| 8,070,186 | B2 | 12/2011 | Einhorn et al. | |
| 2003/0039808 | A1 | 2/2003 | Ichinose et al. | |
| 2003/0148073 | A1 | 8/2003 | Landry-Coltrain et al. | |
| 2004/0224104 | A1 | 11/2004 | DeVries et al. | |
| 2006/0045998 | A1 * | 3/2006 | Kitamura et al. | 428/32.24 |
| 2006/0286315 | A1 | 12/2006 | Hashimoto et al. | |
| 2007/0281136 | A1 | 12/2007 | Hampden-Smith et al. | |
| 2008/0075869 | A1 | 3/2008 | Nelli | |
| 2008/0286488 | A1 | 11/2008 | Li et al. | |
| 2009/0255641 | A1 * | 10/2009 | Seppala et al. | 162/164.3 |

FOREIGN PATENT DOCUMENTS

| | | |
|---|---|---|
| EP | 1321301 | 1/2007 |
| EP | 2081058 | 7/2009 |
| WO | WO-2010140980 | 12/2010 |

OTHER PUBLICATIONS

Tobjörk, D. et al. Abstract of "IR-Sintering of Ink-Jet Printed Metal-Nanoparticles on Paper" Oct. 17, 2011.

* cited by examiner

*Primary Examiner* — Betelhem Shewareged

(74) *Attorney, Agent, or Firm* — HP Inc. Patent Department

(57) ABSTRACT

A printable recording material containing an opaque supporting substrate; a hydrophobic layer; an ink vehicle-receiving layer having a two-layer structure or having bimodal pore size distribution; and an ink colorant-receiving layer comprising inorganic particles. Also disclosed are the method for making such material and the method for producing printed images using said printable recording material.

16 Claims, 1 Drawing Sheet

RECORDING MATERIAL

BACKGROUND

Inkjet technology has expanded its application to high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of media substrates. These printable media or recording material can be cut sized sheets or commercial large format media such as banners and wallpapers. Current inkjet printing technology involves forcing the ink drops through small nozzles by thermal ejection, piezoelectric pressure or oscillation, onto the surface of such media. Within said printing method, the media substrate plays a key role in the overall image quality and permanence of the printed images.

Nowadays, there is a growing demand for digitally printed contents which is no longer limited to the "traditional" black-white text images and full color photo images, but extends also to prints with visual special effects such as the metallic appearance and/or reflectivity, for example. Accordingly, investigations continue into developing media and/or printing methods that can be effectively used with such printing techniques, which imparts good image quality and which allow the production of specific appearances.

BRIEF DESCRIPTION OF THE DRAWING

The accompanying drawings illustrate various embodiments of the principles described herein and are a part of the specification. The illustrated embodiments are merely examples and do not limit the scope of the claims.

DETAILED DESCRIPTION

Figure 1:
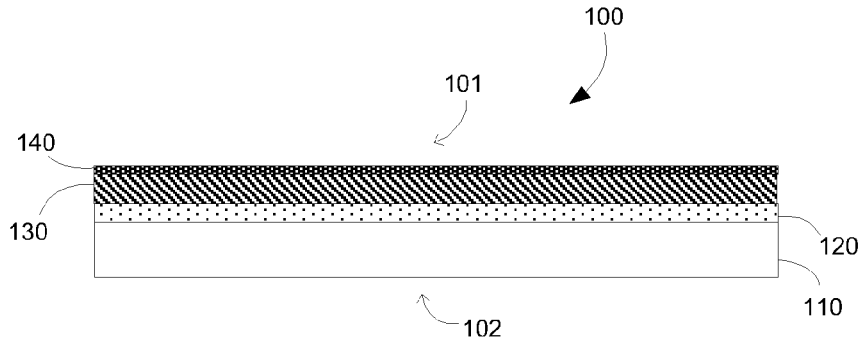
FIGS. 1 and 2 are cross-sectional views of the printable recording material according to embodiments of the present disclosure.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Thus, for example, reference to "a particle" includes reference to one or more of such materials. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percents are by weight (wt %) unless otherwise indicated. As another example, a range of 1 part to 20 parts should be interpreted to include not only the explicitly recited concentration limits of about 1 part to about 20 parts, but also to include individual concentrations such as 2 parts, 3 parts, 4 parts, etc. All parts are dry parts in unit weight, with the sum of the inorganic pigment equal to 100 parts, unless otherwise indicated.

The disclosure describes a printable recording material containing an opaque supporting substrate; a hydrophobic layer; an ink vehicle-receiving layer having a two-layer structure or having a bimodal pore size distribution; and an ink colorant-receiving layer comprising inorganic particles. Also described herein is a method for making such printable recording material. The present disclosure also refers to a method for producing printed images on said printable recording material and to the resulting printed article. Said printing method enables indeed the production of printed articles with a metallic appearance and enables, for example, the creation of text and graphic prints with metallic color appearance on the printable recording material as described herein.

In some examples, the printable recording material is a printable recording medium that is able to exhibit metallic appearance when used in a printing method. In some other examples, such printable recording material is an inkjet recording material well adapted for inkjet printing device. Said material has a multilayered structure that encompasses a bottom supporting substrate and coating layers. Such combination of layers and supporting substrate forms a printable recording medium that has improved printing performances and that is able to generate the images having reflective metallic appearance.

The term "ink receiving layer" refers to layer, or multiple coating layers, that are applied to a supporting substrate and which are configured to receive ink upon printing. As such, the ink receiving layers do not necessarily have to be the outermost layer, but can be a layer that is beneath other coating. Ink receiving layers might be in the form of a porous media coating or in the form of other types of media coatings such as aqueous or organic solvent swellable coatings. In some examples, the printable recording material of the present disclosure is a porous substrate that can be used in inkjet printing and that is able to generate images that combine high metallic reflectivity with an enhanced print image quality. In addition, such printable recording material has high liquid absorbing capacity. Such fast ink absorption results therefore in good print resolution, quality and edge definition.

The metallic appearance can be defined as the human perception of metal luster generated from a smooth metal surface (such as gold, copper, aluminum and chromium). In the principle described herein, the metallic appearance refers to the reflected light wave that is perceived by observer from a strong specular (directional) light reflection off the object surface. A surface appears having a metallic luster, from human perception, if it is able to reflect at specular angle greater than 10 to 20% of the incident light intensity (Highly polished smooth surface of metals elements such as gold, copper, aluminum and chromium can reflect up to 85 to 95% of incident visible light). The higher the intensity of the reflected light at specular angle is (combined with low reflection off specular angle), the stronger metallic appearance is.

The Printable Recording Media

Figure 2:
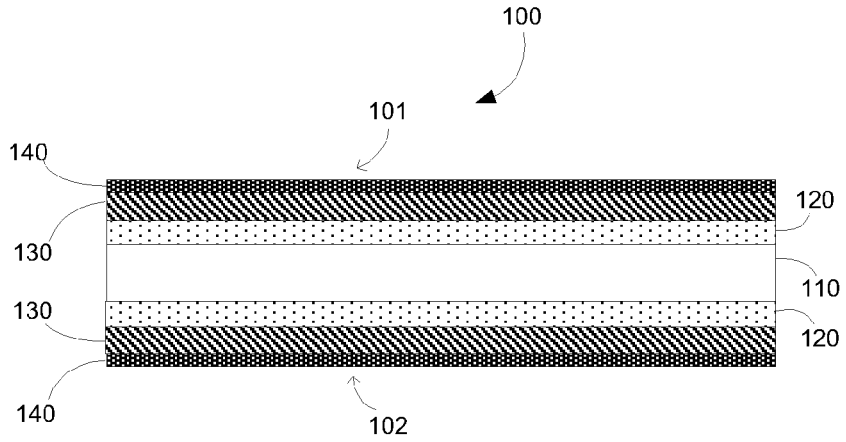

FIG. 1 and FIG. 2 illustrate embodiments the printable recording material (100) as described herein. As will be appreciated by those skilled in the art, the figures illustrate the relative positioning of the various layers of the recording media (100) without necessarily illustrating the relative thicknesses of said layers.

FIG. 1 illustrates some embodiments of the recording media (100). Such media includes a hydrophobic substance which can form either a layer (120) that is applied on the image side (101) of the base substrate (110), or mix into the fiber furnish in wet end of base substrate making. The recording media (100) encompasses, also, an ink vehicle-receiving layer (130) that is applied over the hydrophobic layer (120) and an ink colorant-receiving layer (140) that is deposited at the surface of said ink vehicle-receiving layer (130). The supporting substrate (110) has two surfaces: a first surface that might be referred to as the "image surface" or "image side" (101), and a second surface, the opposite surface, which might be referred to as the "back surface" or "back side" (102). FIG. 1 illustrates some embodiments of the recording material (100) wherein such material includes a hydrophobic layer (120), an ink vehicle-receiving layer (130), and an ink colorant-receiving layer (140) applied only on the image side (101) of the supporting substrate (110).

FIG. 2 illustrates some other embodiments of the recording material (100) wherein such material includes hydrophobic layers (120), ink vehicle-receiving layers (130) and ink colorant-receiving layers (140) that are deposited on both sides of the supporting substrate (110). Said layers are thus present on the backside (102) and on the image side (101) of the base substrate (110). FIG. 2 illustrates thus a double-side recording material (100) that has a sandwich structure, i.e. both sides of the supporting substrate (110) are coated with the same coating and both sides may be printed.

Figure 3:
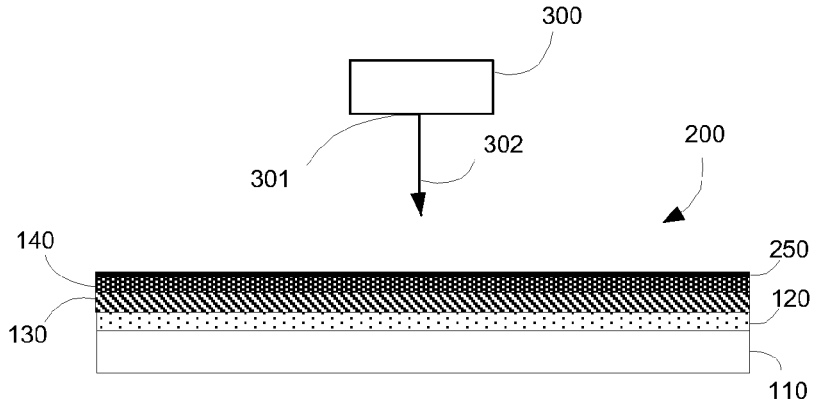
FIG. 3 is a cross-sectional view illustrating methods for producing printed articles according to some embodiments of the present disclosure.

FIG. 3 illustrates an example of printing method for forming a printed article according to the present disclosure. In such method, the printer (300) has, at least, one orifice (301) that dispenses droplets of ink composition along a trajectory (302), to the surface of the printable recording media, on the ink colorant-receiving layer (140), in view of forming a printed article (200) that encompasses a printed feature (250). In some examples, said printed feature (250) contains metal oxide particles that are retained at the surface of the ink colorant-receiving layer (140) and that form a metal oxide coating layer. The average pore size of the ink colorant-receiving layer (140) is small enough to retain practically all metal oxide particles on the surface while, in the same time, absorbing the liquid phase of the ink composition into the media.

The Supporting Substrate

In some embodiments, the recording material (100) encompasses an opaque supporting substrate (110). The supporting substrate is a base layer that provides mechanical strength and stiffness to the recording material and provides surfaces on which coatings can be formed. The terms "opaque", as used herein, refers to a material that is not transparent (but may have a uniform color, multiple colors, or particles of color) and images cannot be seen through it at all, or only slightly and not clearly. The degree of opacity could be defined as the measurement of impenetrability to electromagnetic or any other kinds of radiation, especially visible light. In some examples, the opacity of the supporting substrate (110) is greater than 80%, or greater than 85%, when measured with the TAPPI Method T 425 om-11.

The coatings, in accordance with the principles described herein, can be applied to one side or to both opposing sides of the supporting substrate. If the coated side is used as an image-receiving side, the other side, i.e. backside, may not have any coating at all, or may be coated with other chemicals (e.g. sizing agents) or coatings to meet certain needs such as to balance the curl of the final product or to improve sheet feeding in printer. The supporting substrate (110), on which coating compositions are applied, may take the form of a media sheet or a continuous web suitable for use in an inkjet printer. The supporting substrate may be a base paper manufactured from cellulose fibers. The base paper may be produced from chemical pulp, mechanical pulp or from pulps resulting from hybrid processes, such as thermo-mechanical pulp (TMP) and chemio-thermomechanical pulps (CTMP). The cellulose fibers can be made from hardwood or softwood species where hardwood fibers may have an average fiber length between about 0.5 to about 3 mm and where softwood fibers may have an average length between about 3 and about 7 mm. The ratio of hardwood to softwood fibers can range from 100:0 down to 50:50. In some examples, the hardwood to softwood fiber ratio is of about 80:20 by weight. The supporting substrate can include both cellulose fibers and synthetic fibers. The use of synthetic fiber might improve dimension stability and reduce moisture absorption when excessive aqueous ink vehicle is jetted on the receiving materials. The synthetic fibers can be made by polymerization of organic monomers. The synthetic fibers include fibers formed from polyolefins, polyamides, polyesters, polyurethanes, polycarbonates and polyacrylics. Other examples of the synthetic organic fibers made from polyolefins or polyolefin copolymers include polyethylene fibers, polyethylene copolymer fibers, polypropylene fibers, polyethylene copolymer fibers, or polypropylene copolymer fibers. Polyethylene or polypropylene copolymers may refer to the copolymers of ethylene and/or propylene with linear alkenes such as 1-butene, 1-hexene, 1-octene, 1-decene, 1-dodecene, 1-tetradecene, 1-hexadecene and 1-octadecene. Polyethylene or polypropylene copolymers can also refer to the copolymers of ethylene and/or propylene with branched alkenes, such as isobutene. Ethylene copolymer can be ethylene with vinyl acetate and with partial or complete hydrolysis products, such as polyvinyl alcohol fibers. In some examples, the content of the synthetic fiber is from about 3 to about 50 wt % of the total fiber weight or could be in the range of about 5 to about 20 wt % of total fiber weight.

The supporting substrate (110) can includes additives such as internal sizing agents and fillers. Without being linked by any theory, the internal sizing agent may provide hydrophobicity to the base and fillers may contribute to a higher opacity. The paper base can contain fillers in an amount representing from about 5% to about 50% by total weight of the raw base. As a non-limiting example, the fillers may be selected from calcium carbonate, talc, clay, kaolin, titanium dioxide and combinations thereof. In some examples, the supporting substrate includes $TiO_2$ particles as inorganic fillers in order to improve opacity.

The supporting substrate (110) can include inorganic fillers in an amount representing from about 8 wt % to about wt 40% by total weight of the supporting substrate, or in an amount ranging from about 10 wt % to about wt 30%. In some examples, the inorganic fillers is a mixture of calcium carbonate and $TiO_2$ particles and is present in an amount representing more than about 15 wt % by total weight of the supporting substrate. Said mixture of calcium carbonate and $TiO_2$ particles has a weight percentage of about 5 wt % to about 30 wt % of fillers per total weight of the mixture.

The supporting substrate (110) can have a base weight ranging from about 90 to about 300 grams/meter$^2$ (gsm), or can have a base weight ranging from about 100 to about 220 gsm.

The Hydrophobic Layer

The printable recording material (100) encompasses a hydrophobic layer (120). Said hydrophobic layer can form either a coating layer that is applied on the base substrate (110), or that is mixed into the fiber furnish in wet end of base substrate making. In some examples, the hydrophobic layer (120) is deposited on, at least, one side of the base substrate (110) or is deposited on both side of the supporting substrate (110).

The word "layer" refers, herein, to a continuous layer, or to an essentially continuous layer, when it is applied on one side of the base substrate (110) or is deposited on both side of the supporting substrate (110). It means thus that the layer may present in a form of numerous non-continuous domain on the surface (from a macro-perspective), but the molecules of the hydrophobic substance, which form the hydrophobic layer, are spread out on the whole surface (from a micro-perspective). The word "hydrophobic" refers to continuous layers that have a strong hydrophobicity to repel a mass of water or any other aqueous solvent, or that lack affinity for, or the ability to, absorb water. Without being linked by any theory, it is believed that said layer helps to avoid excessive absorption of aqueous solvents into the media substrate, i.e. helps to prevent aqueous solvent of the ink vehicle to penetrate into the cellulose fiber base. Indeed, inkjet ink contains large amount of aqueous solvents, mostly water. When such ink is applied on the receiving media, the excessive aqueous solvent can be absorbed into the substrate and cause cellulose fiber swelling. This effect may cause adversely paper cockling, paper wrinkling, and destroy paper smoothness which in turn reduce light reflectance. The hydrophobic layer (120) creates a smooth surface and high gloss surface (i.e. superior to 80 gloss unite at 75 degree observation angle). The hydrophobic layers (120) can be a single layer, or a multiple layers that aims to reduce the penetration of exterior moisture into the substrate (110).

In some examples, the hydrophobic layer (120) is part of the supporting substrate and encompasses a polymeric hydrophobic substance. In some other examples, the hydrophobic layer (120) is applied over the supporting substrate and encompasses a polymeric hydrophobic substance.

The polymeric hydrophobic substance has non-polar molecules and/or some polar molecules with special molecular structure such as cross-link. Example of such polymeric substances include, but is not limited to, cross-linked starch, cross-linked polyvinyl alcohol, polyvinyl acetate (with low degree esterification), acrylates or methacrylate polymers and copolymers, polyvinyl chloride, styrene-butadiene copolymers poly(ethylene-vinyl acetate) copolymer, polyethylene and polypropylene homopolymer, poly-tetrafluoroethylene, alkyl ketene dimer (AKD), alkyl succinic anhydride (ASA), reaction product of a hydrocarbon wax with rosin resin, vinylidene chloride latex, and silicones. The polymeric substances are water dispersible in latex and/or emulsion forms to be readily applied on the substrate surface. Non-water dispersible materials such as polyethylene, polypropylene and copolymers in granule forms are not suitable as these materials request a high temperature application to generate a continuous film such as in the case of extrusion coating.

In some examples, the hydrophobic layer (120) encompasses, at least, a self-crosslinkable polymeric hydrophobic substance and, at least, an amphiphile substance. Said amphiphile substance can be part of the polymeric hydrophobic mixture and is thought to provide a stable and balance effect on hydrophobicity and a good coating ability of the hydrophobic layer. Such amphiphile substance is macromolecular substance where a block of hydrophilic monomer units are polymerized together to form a hydrophilic segment and lipophilic monomers are polymerized together to form a lipophilic segment. The resultant substances have separated hydrophilic and lipophilic parts. In some examples, the amphiphile substance is poly(ethylene-oxide), poly(propylene-oxide), copolymer of maleic acid and styrene, salts of polyacrylic acid, carboxy-methyl cellulose, poly-siloxane with polyoxyalkylene block molecule and hydrocarbon block of the molecule.

In some examples, the hydrophobic layer (120) encompasses, at least, a self-crosslinkable polymeric hydrophobic substance in an emulsion form and, at least, a surfactant. In some other examples, the hydrophobic layer encompasses a moisture repelling agent and, at least, a surfactant. The hydrophobic layer can also contain a fluoro-containing polymeric substance. Such fluoro-containing polymeric substance contains a fluorinated carbon chain in linear, branched chain, and cyclic chain structure and fluoro-silicone copolymers. More than 30 wt % of fluorine can be included into the polymer chain in view of achieving optimized effect, and the end groups of the polymer chain can be fluorinated.

In some examples, when the hydrophobic layer is part of the supporting substrate the polymeric hydrophobic substance is mixed into the fiber furnish in wet end of substrate making Said polymeric substance is, thus, mixed into the cellulose fiber furnish during wet end process of paper/substrate making, along with non-wood/non-cellulose fibers to form a pulp mixture which is then converted into substrate on the wiring belt of the paper machine. The non-wood/non-cellulose fibers include some inorganic fibers and some resinous organic fibers. Example of inorganic fibers includes carbon fibers. When inorganic fibers are used as low moisture absorbing fibers, they may be present in an amount ranging from about 5 wt % to about 20 wt % of the total amount of fibers used. Examples of the resinous organic fibers are synthetic fibers made by the polymerization of one or more organic monomers. Synthetic organic fibers may be made from polyolefins or polyolefin copolymers, polyamides, polyesters, polyurethanes, polycarbonates, or polyacrylics. More specific examples of the synthetic organic fibers made from polyolefins or polyolefin copolymers include polyethylene fibers, polypropylene fibers, polyethylene copolymer fibers, or polypropylene copolymer fibers. In some examples, polyethylene or polypropylene copolymers refer to the copolymers of ethylene and/or propylene with linear alkenes such as 1-butene, 1-hexene, 1-octene, 1-decene, 1-dodecene, 1-tetradecene, 1-hexadecene, and 1-octadecene. In some other examples, polyethylene or polypropylene copolymers refer to the copolymers of ethylene and/or propylene with branched alkenes, such as isobutene. In yet some other examples, the ethylene copolymer is ethylene with vinyl acetate and its partial or complete hydrolysis products, such as polyvinyl alcohol fibers. When synthetic fibers are used as the low moisture absorbing fibers, they may be present in an amount ranging from about 5 wt % to about 60 wt % of the total amount of fibers used. In some examples, the base substrate containing polymeric hydrophobic layer and/or hydrophobic substance mixture with fibers has a water intake of less than 1.5% by weight when exposed to 30° C. and 80% humidity for 24 hours.

The hydrophobic layers (120) can be deposited on both sides of the base substrate (110). The coat-weight of the hydrophobic layer can range from about 0.01 to about 20 grams/meter$^2$ (gsm) or from about 0.2 to about 5 grams/meter$^2$ (gsm). The hydrophobic layer can be applied onto the substrate by paper methods such as size press, slot die, blade coating and Meyer rod, film transfer coating, air knife coating, slot die coating and/or curtain coating. The size presses include puddle-sized press, film-sized press and the like. The puddle-size press may be configured as having horizontal, vertical, or inclined rollers. The film-sized press may include a metering system, such gate-roll metering, blade metering, Meyer rod metering, or slot metering. A film-sized press with short-dwell blade metering may be used as an application head to apply the coating solution.

The Ink Vehicle-Receiving Layer

The printable recording material (100) of the present disclosure encompasses an ink vehicle-receiving layer (130). Without being linked by any theory, it is believed that said layer has a porous receiving surface and a porous bulk structure that can absorb ink vehicle quickly so that ink bleeding or coalescence can be minimized. In addition, such ink vehicle-receiving layer (130) provides a smooth media surface that enhances incident light reflection and therefore, enhances metallic appearance when metallic ink is applied to the recording medium.

The ink vehicle-receiving layer (130) can have two different structures: in one embodiment, the ink vehicle-receiving layer encompasses a two-layer structure: a first structure with inorganic particles and, at least, a binder; and a second structure with nano-porous particles and, at least, a binder. In one other embodiment, the ink vehicle-receiving layer is a coating composition with bimodal pore size distribution.

In some examples, the ink vehicle-receiving layer (130) is a layer that encompasses two-layer structure: a first structure with inorganic particles and, at least, a binder; and a second structure with nano-porous particles and, at least, a binder. The first structure contains inorganic particles and at least a binder, which provide adhesion force between particles and hydrophobic layer, and adhesion force among particles. The first structure can have an average pore size in the range of about 70 nm to about 250 nm or in the range of about 80 nm to about 200 nm or in the range of about 100 nm to about 170 nm. The thickness of the first structure ranges from about 3 to about 25 micrometers (μm). The first structure can be applied with a coating weight ranging from about 5 to about 30 grams/meter$^2$ (gsm), or with a coat weight ranging from about 10 to about 20 gsm.

The first structure includes inorganic pigments. The inorganic pigments can have an average particle size ranging from about 0.1 to about 1 μm or have an average particle size that is less than about 0.4 μm. Examples of inorganic pigments are, but not limit to, titanium dioxide, hydrated alumina, calcium carbonate, barium sulfate, silica, zinc oxide, zeolite, alumina, boehmite, silicates (such as aluminum silicate, magnesium silicate and the like), aluminum trihydrate (ATH), titania, zirconia, clay, calcium silicate, kaolin clay, calcined clay or combinations thereof. The physical form of the pigments can be either powder or aqueous pre-dispersed slurry. Other inorganic particles such as particles of titanium dioxide ($TiO_2$), silicon dioxide ($SiO_2$), aluminum tri-hydroxide (ATH), calcium carbonate ($CaCO_3$) and zirconium oxide ($ZrO_2$) can be inter-calcined into the structured clay or calcium carbonates. In some examples, the inorganic pigments of the first structure are calcium carbonates or clays.

The second structure, of the ink vehicle-receiving layer (130) with two-layer structure, has an average pore size that is smaller than the average pore size of first structure. The second structure can have an average pore size that is about 5 to 15 times smaller than the average pore size of first structure. The second structure can have an average pore size in the range of about 10 nm to about 100 nm, or in the range of about 20 nm to about 70 nm.

In some examples, the printable recording material has an ink vehicle-receiving layer (130) with two-layer structure, that encompasses a first structure with an average pore size in the range of about 70 nm to about 250 nm and a second structure with an average pore size in the range of about 10 nm to about 100 nm.

The thickness of the second structure may range from about 0.3 to about 15 μm, or ranges from about 2 to about 10 μm. The second structure can be applied over the first structure with a coating weight of about 0.4 to about 15 grams/meter$^2$ (gsm), or with a coat weight ranging from about 1 to about 10 gsm. In some embodiments, the ink vehicle-receiving layer (130) with two-layer structure, encompasses a first structure that is applied over the hydrophobic layer (120) with a coating weight of about 5 to about 30 gsm, and a second structure that is applied over the first structure with a coating weight of about 0.3 to about 15 gsm.

The second structure contains nano-porous particles and, at least, a binder. The "nano-porous particles" are primary particles or aggregated "macro-particles", both in the nanometer range. The primary particles are not necessarily porous but are able to form porous aggregated particles. Examples of nano-porous particles are fumed silica, fumed alumina, boehmite and pseudo-boehmite. The inorganic pigment particles can be fumed silica (modified or unmodified). Commercially available fumed silica encompasses Cab-O-Sil®LM-150, Cab-O-Sil®M-5, Cab-O-Sil®MS-55, Cab-O-Sil®MS-75D, Cab-O-Sil®H-5, Cab-O-Sil®HS-5, Cab-O-Sil®EH-5, Aerosil®150, Aerosil®200, Aerosil®300, Aerosil®350 and/or Aerosil®400.

In some examples, both the first and the second structure, of the ink vehicle-receiving layer (130) with two-layer structure, encompass binders that are independently chosen. In some examples, at least a binder is used in the coating formulation of the first structure and at least a binder is used in the coating formulation of the second structure of the ink vehicle-receiving layer (130). The binders can be water soluble binders, water dispersible polymers or polymeric emulsions that exhibit high binding power for base paper stock and pigments, alone or as a combination. The amount of binder in the first structure and in the second structure of the ink vehicle-receiving layer may be in the range of about 5 to about 15 parts. Such binders can be homopolymer and/or copolymer of polyvinylalcohol polyvinylpyrrolidone and polyacrylate. The copolymers can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate or methyl vinylketone. Examples of binders include Poval®235, Mowiol®56-88, Mowiol®40-88 (products of Kuraray and Clariant).

Both the first structure and second structure may further include other additives such as mordants, biocides, surfactants, plasticizers, rheology modifiers, defoamers, optical brighteners, pH controlling agents, or other additives for further enhancing the properties of the coating. Among these additives, rheology modifier is useful for addressing runnability issues. Suitable rheology modifiers include polycarboxylate-based compounds, polycarboxylated-based alkaline swellable emulsions, or their derivatives.

In some examples, the ink vehicle-receiving layer (130) encompasses a fused interface located between the first structure and the second structure. Such fused interface can be defined as the range along z-direction where inorganic particles of the first structure and of the second structure co-exist. The thickness of interface can be between about 1 and about 5 micrometer (μm). To create such fused interface structure, a wet-to-wet coating method could be applied. In some examples, particles of the second structure are applied on the top of the first structure when it is still in the low viscosity status without drying. The density ratio of the second structure composition to that of the first structure composition can be in the range of from 0.6 to 0.85, or from 0.7 to 0.8. The viscosity of the first structure composition can be from 1.3 to 1.7 times lower than that of the second structure composition.

In some embodiments, the ink vehicle-receiving layer (130) is a coating composition with bimodal pore size distribution. By "bimodal pore size distribution", it is meant herein that the coating composition encompasses large pore size as well as small pore size. The bimodal pore size distribution refers to the plotting of percentage pore volume vs. pore diameter, which are measured by a pore size tester (such as AutoPore Automated Mercury Porosimeter, supplied by Micrometrics Inc.), when the plots shows a continuous probability distribution with two different modes, it appear as at least two distinct peaks (local maxima) (in the probability the pore volume functions with pore size as the variable). The bimodal pore size distribution can also be measured by a mercury porosimeter where the pore size diameter is plotted against log differential intrusion of mercury (mL/g). The ink vehicle-receiving layer with bimodal pore size distribution can have thus a pore size distribution with two clear maxima corresponding to small pores (centered at around 5 to 50 nm) and larger pores (centered at around 100 to 600 nm), for example.

The ink vehicle-receiving layer with bimodal pore size distribution (130) encompasses a primary permanently positive charged particles; a secondary permanently positive charged particles; a metallic salt; and a binder. In some examples, the primary permanently positive charged particles are permanently positive charged clay particles (i.e. reversed charged clay particles).

The reverse charge of the clays is carried out in an acidic environment with the use of a reverse charge agent that can be an organosilane or mixture of organosilanes having the structure: $(RO)_3SiR'$-N wherein R and R' are any chemical group selected from the group consisting of alkyl groups, aromatic groups and hetero-aromatic groups. In some examples, the RO groups are hydrolysable in neutral to acidic condition. Examples of RO group include methoxy, ethoxy, alkoxy or acetoxy group. N is a group which can be converted into a cationic charged function group. Examples of N groups are nitrogen containing groups, such as but not limited to, carboxamides —CO—$NH_2$; primary amine —$RNH_2$; secondary amine $R_2NH$; tertiary amine $R_3N$ and pyridines; —$RC_5H_4N$ which can convert to cationic pyridinium, like 4-pyridyl, 3-pyridyl and 2-pyridyl. In some examples, N groups are nitrogen containing various levels of substituted amines. The degree of charge reversing on clay surface is monitored by measuring Z-potential of aqueous slurry using a Zeta potential instrument. In some examples, the Z-potential on clay surface is in the range of about 5 to about 35 mV and, in some other examples, is in the range of about 15 to about 25 mV. In some examples, the positive charged clay particles have a particle size in the range of about 0.2 to about 1.5 micrometers (μm), or in some other example in the range of about 0.1 to about 1.0 micrometers (μm).

In some examples, the ink vehicle-receiving layer with bimodal pore size distribution (130) encompasses primary permanently positive charged clay particles that have a first peak, in the range of about 100 to about 600 nanometers (nm) and a second peak, is in the range of about 10 to about 40 nanometers (nm).

In some examples, the ink vehicle-receiving layer with bimodal pore size distribution (130) encompasses metallic salts, including water-soluble or water-dispersible metallic salts. The ink vehicle-receiving layer with bimodal pore size distribution (130) further encompasses a second type of the pigment particles. In some examples, the secondary permanently positive charged particles are any inorganic particles with an aggraded particle size in the range of about 10 to about 150 nanometers (nm). Said secondary positive charged particles are permanently positive charged.

In some examples, the surface area of the second type of pigment particles is not smaller than 100 $m^2/g$, or not smaller than 150 $m^2/g$. In some other examples, the second type of pigment particles is permanently positive charged silica particles. Examples of such pigment particles are silica and fumed silica such as Cab-O-Sil® MS-55 (available from Cabot Ltd), Orisil® 200, Orisil® 250 and Orisil® 300 (available from Orisil Ltd). In some examples, the ink vehicle-receiving layer with bimodal pore size distribution (130) encompasses a binder. Examples of binders include cationic or neutral charged acrylic latex, SBR latex (styrene-butadiene rubber latex), polyvinyl alcohol, polyvinyl-polypyrrolidone and virgin or chemical modified starches.

The Ink Colorant-Receiving Layer

An ink colorant-receiving layer (140) is applied on top of the ink vehicle-receiving layer having a two-layer structure or having a bimodal pore size distribution (130); said ink colorant-receiving layer encompasses inorganic particles. Without being bounded by any theory, it is believed that the ink colorant-receiving layer (140) plays dual functions. One function is to form a physical barrier layer which constrains most of the metallic ink colorant particles at the outmost surface, while its specific packed pore size can provide capillary force and flow path to allow the ink vehicle penetrating into the ink vehicle-receiving layer (130). The "packed pore size" refers to the average pore size as measured by Mercury Porosimeter on the coated surface after it is solidified.

The average pore size of the ink colorant-receiving layer (140) is smaller than the average pore size of the ink vehicle-receiving layer (130), having a two-layer structure or having a bimodal pore size distribution, in view of retaining the metal oxide particles of the ink on media surface. In some examples, the ink colorant-receiving layer (140) has an average pore size that is less than 50 nm; in some other examples, that is less than 30 nm. The thickness of the ink colorant-receiving layer (140) can be in the range of about 100 nm and about 600 nm.

In some examples, the ink colorant-receiving layer (140) encompasses inorganic particles having a refractive index (n) superior or equal to 1.65. In some other examples, the refractive index (n), of the inorganic particles, is in the range of about 1.7 to about 2.5. In yet some other example, the refractive index (n) is between about 1.2 and about 1.8. The refractive index, or index of refraction, of the inorganic particles is the measure of the speed of light in metal oxide particles. It is expressed as a ratio of the speed of light in vacuum relative to that in the particles medium.

The inorganic particles can be metal oxides or complex metal oxides particles. As used herein, the term "metal oxide particles" encompasses metal oxide particles or insoluble metal salt particles. Metal oxide particles are particles of metal oxide that have high refractive index (i.e. more than 1.65) and that have particle size in the nano-range such that they are substantially transparent to the naked eye. In some examples, the metal oxide particles are either colorless or have rather weak coloration in thin layers. In some examples, the average size of the oxide particles is smaller than ¼ wavelengths (¼ λ) of the visible wavelength. The visible wavelength is ranging from about 400 to about 700 nm. Therefore, the average size of the metal oxide particles is between about 3 and about 180 nm or may also be between about 5 and about 150 nm. In some examples, the average size of the metal oxide particles is between about 10 and about 100.

Non limiting examples of inorganic particles, that are part of the ink colorant-receiving layer (140), are white or colorless materials such as aluminum oxide, aluminum phosphate, nanocrystalline boehmite alumina (AlO(OH)), beryllium oxide, dysprosium oxide hafnium(IV) oxide, lutetium oxide, scandium oxide, tantalum pentoxide, tellurium dioxide, titanium dioxide, zinc oxide, zirconium dioxide, barium titanate calcium molybdate, calcium tungstate, gallium arsenide oxide, gallium antimonide, oxide potassium niobate, potassium tantalate, potassium titanyl phosphate, lithium iodate, lithium niobate, silicon dioxide, strontium titanate, yttrium aluminium garnet or yttrium vanadate.

In some examples, the ink colorant-receiving layer (140) contains inorganic particles that can be selected from the group consisting of aluminum oxide ($Al_2O_3$), silicon dioxide ($SiO_2$), nanocrystalline boehmite alumina (AlO(OH)) and aluminum phosphate ($AlPO_4$). In some other examples, the ink colorant-receiving layer (140) contains aluminum oxide ($Al_2O_3$) or silicon dioxide ($SiO_2$). In yet some other examples, the ink colorant-receiving layer (140) contains aluminum oxide ($Al_2O_3$). The ink colorant-receiving layer (140) may also contain a binder that can be independently selected from the binders present in the ink vehicle-receiving layer having a two-layer structure or having a bimodal pore size distribution (130).

The ink colorant-receiving layer (140) can be formed with variety of suitable coating methods, such as: blade coating, air knife coating, metering rod coating, film transfer coating, slot die coating, curtain coating, pressure jetting coating, thermal jetting coating, spray coating or another suitable technique. It can be also formed by other deposition techniques such as plasma deposition, sputtering deposition, and electron beam deposition. In some embodiments, the ink colorant-receiving layer (140) is applied over the ink vehicle-receiving layer having a two-layer structure or having a bimodal pore size distribution (130) with a coating weight of about 0.01 to about 5 gsm, or with a coating weight of about 0.1 to about 2 gsm.

Method for Making the Printable Media

A method of making the printable recording media (100), such as defined above, includes providing an opaque supporting substrate; applying a hydrophobic layer (120) onto said opaque supporting substrate (110) applying an ink vehicle-receiving layer having a two-layer structure or having bimodal pore size distribution (130); depositing an ink colorant-receiving layer (140), containing inorganic particles, on top of said layers; and drying and calendaring the layers. The hydrophobic layer (120), the ink vehicle-receiving layer (130) and the ink colorant-receiving layer (140) can be coated onto the supporting substrate (110) via any coating techniques, followed by drying techniques. Methods of application may include, but are not limited to, curtain coating, cascade coating, fountain coating, slide coating, slot coating, blade coating, rod coating, air-knife coating, size-press (including puddle and metered size press), or hopper coating.

Method for Producing Printed Images

In some examples, a method for forming printed images on the printable recording material described above include: obtaining a printable recording material containing an opaque supporting substrate; a hydrophobic layer; an ink vehicle-receiving layer having a two-layer structure or having bimodal pore size distribution; and an ink colorant-receiving layer containing inorganic particles; providing an ink composition and applying said ink composition onto said recording material, to form a printed image.

The method for forming printed images can be done by means of digital printing technology. In some examples, the ink composition is applied by projecting a stream of droplets of ink composition onto the printable recording material, via an inkjet printing technique. The ink composition may be established on the printable recording medium via any suitable inkjet printing technique. Non-limitative examples of such inkjet printing technique include thermal, acoustic, continuous and piezoelectric inkjet printing. In some examples, the ink compositions used herein are inkjet compositions; it is meant thus that said ink compositions are well adapted to be used in an inkjet device and/or in an inkjet printing process.

By inkjet printing technique, it is meant herein that the ink is applied using inkjet printing devices. Within inkjet printing devices, liquid ink drops are applied in a controlled fashion to a print medium by ejecting ink droplets from a plurality of nozzles, or orifices, in a printhead of an inkjet printing device or inkjet printer. In some examples, ink compositions may be dispensed from any piezoelectric or drop-on-demand inkjet printing devices. Such inkjet printing devices can be available from Hewlett-Packard Inc. (Palo Alto, Calif., USA) by way of illustration and not limitation. In drop-on-demand systems, a droplet of ink is ejected from an orifice directly to a position on the surface of a print medium by pressure created by, for example, a piezoelectric device, an acoustic device, or a thermal process controlled in accordance digital data signals. An ink droplet is not generated and ejected through the orifices of the printhead unless it is needed. The volume of the ejected ink drop is controlled mainly with a printhead. The printed or jetted ink may be dried after jetting the ink composition in a predetermined pattern onto a surface of a print medium. When present, the drying stage may be conducted, by way of illustration and not limitation, by hot air, electrical heater or light irradiation (e.g., IR lamps), or a combination of such drying methods. In order to achieve best performance it is advisable to dry the ink at a maximum temperature allowable by the print medium that enables good image quality without print medium deformation. In some examples, a temperature during drying is about 40° C. to about 150° C.

The ink composition, referred herein, may encompass one or more colorants that impart the desired color to the printed message. As used herein, "colorant" includes dyes, pigments and/or other particulates that may be suspended or dissolved in an ink vehicle. In some other examples, the ink composition includes pigments as colorants. Pigments that can be used include self-dispersed pigments and non self-dispersed pigments. Pigments can be organic or inorganic particles. Such pigments are commercially available from vendors such as Cabot Corporation, Columbian Chemicals Company, Evonik, Mitsubishi and DuPont de Nemours; and can be colored pigments, such as, for examples, cyan, magenta, yellow, blue, orange, red, green, pink or black pigments.

In some examples, the ink composition is a metalized ink composition and encompasses dispersed metal oxide particles. The "metal oxide particles" are particles that have particle size in the range such that they are substantially transparent to the naked eye. Said metal oxide particles have an average particle size in the range of about 3 to about 300 nm, or in the range of about 10 to about 100 nm. The metal oxide particles can have an average particle size in the range of about 10 to about 50 nm, or in the range of about 20 to about 30 nm. Metal oxide particles include metal oxide pigments selected from the group consisting of titanium dioxide ($TiO_2$), in rutile or anatase crystalline form, zinc oxide (ZnO), indium oxide ($In_2O_3$), manganese oxide ($Mn_3O_4$) and iron oxide ($Fe_3O_4$). In some examples, the metal oxide particles are iron oxide ($Fe_3O_4$) or manganese oxide ($Mn_3O_4$) particles. The ink composition can contain iron oxide ($Fe_3O_4$) as metal oxide particles.

Metal oxide particles contained in the ink compositions may have a refractive index (n) that is different from the refractive index of the inorganic particles present in the ink colorant-receiving layer (140). In fact, the bigger the differences in the refractive index (n) are, the better the reflectivity of the printed article is.

In some examples, the ink composition is an inkjet ink composition that contains, at least, metal oxide particles and an aqueous carrier. In some other examples, the ink composition contains a metal oxide, a dispersant and a liquid vehicle. The amount of the metal oxide particles can represent from about 0.1 to about 10 wt % of the total weight of the ink composition. Examples of suitable dispersants include, but are not limited to, water-soluble anionic species of low and high molecular weight such as phosphates and polyphosphates, phosphonates and polyphosphonates, phosphinates and polyphosphinates, carboxylates (for example, citric acid or oleic acid), polycarboxylates (for example, acrylates and methacrylates), hydrolysable alkoxysilanes with alkoxy group attached to water-soluble (hydrophilic) moieties such as water-soluble polyether oligomer chains (for example, polyether alkoxysilanes). In some examples, the dispersant is a polyether alkoxysilane dispersant.

The ink compositions described herein contains colorant or metal oxide particles that are dispersed in a liquid vehicle or liquid carrier. "Liquid vehicle" is defined to include any liquid composition that is used to carry metal oxide particles or pigments to the substrate. Such liquid vehicles may include a mixture of a variety of different agents, including without limitation, surfactants, solvents and co-solvents, buffers, biocides, viscosity modifiers, sequestering agents, stabilizing agents and water. Though not liquid per se, the liquid vehicle can also carry other solids, such as polymers, UV curable materials, plasticizers, salts, etc.

The Printed Article

The printing method that encompass obtaining a printable recording material (100) containing an opaque supporting substrate; a hydrophobic layer (120); an ink vehicle-receiving layer having a two-layer structure or having bimodal pore size distribution (130); and an ink colorant-receiving layer; providing an ink composition; and applying said ink composition onto said recording material, results in a printed article with enhanced image quality and enhanced absorption performances. Such as illustrated in FIG. 3, the printed article (200) encompasses thus a printable recording material (100) containing an opaque supporting substrate (110), a hydrophobic layer (120), an ink vehicle-receiving layer (130), and an ink colorant-receiving layer (140) with inorganic particles; and a printed feature (250) applied on top of said printable recording material.

In some examples, when the ink composition encompasses metal oxide particles with an average particle size in the range of about 3 to about 300 nm, said method results in prints with strong "metallic" appearance and high print quality/sharp details resolution. The jetting of the ink composition, that contains metal oxide particles, result in printed articles (200) with metallic color appearance and metallic luster. The resulting printed article can have a uniform coating with strong sparkling and metallic reflective appearance. By "metallic luster", it is meant herein that the printed article has an opaque or a semi-opaque appearance and reflects the light as a metal reflects it. The printed article interacts with the light and has a shiny metal appearance. The printed article has, thus, specific optical properties: it exhibits a sort of glow from reflected light and has the tendency to reflect at specular angle when exposed to directional light source. In some examples, the printed article has a gold appearance. By "gold-like appearance", it is meant herein that the printed article has a visual appearance of gold-plated surface and has the color of metallic gold (Au). However, the printed article does not contain any gold or other elemental metal particles. The printed article exhibits thus gloss and sheen as a gold object does.

For optimum metallic appearance, the printed article (200) encompasses a printed feature (250) that can be considered as a metal oxide coating layer. Said printed feature can contain metal oxide particles that are presents in the metalized ink composition. In some examples, the printed feature (250) is a metal oxide coating layer.

Said printed feature can be a planarized optically reflective layer that encompasses metal oxide particulates, with a thickness that is in the range of about 1 to about 600 nm, or, between about 3 to about 300 nm. The metal oxide coating layer can have a density in the range about 3 to about 80 $\mu g/cm^2$ or a density in the range of about 10 to about 40 $\mu g/cm^2$. Said metal oxide layer can be optically transparent or semi-transparent.

The printed article can be useful for forming printed images that have, for examples, decorative applications, such as greeting cards, scrapbooks, brochures, book covers, signboards, business cards, certificates, interior design, stunning portraits, various package and other like applications. In some other examples, such printed article can be used as printed media used in printing techniques.

The preceding description has been presented only to illustrate and describe some embodiments of the present invention. However, it is to be understood that the following are only illustrative of the application of the principles of the present recording material and methods.

EXAMPLE

Ingredients:

- Opercarb®A40 is precipitated calcium carbonate (PCC) available from SMI.
- Ansilex®93 is a clay from BASF.
- Plurnoic®L61 is a surfactant available from BASF.
- Dynwet®800 is a surfactant available from BYK Inc.
- VAPC®T330 C is a moisture repelling agent available from Michelman Inc.
- Mowiol®40-88 is polyvinyl alcohol (PVA) binder available from Kurraray.
- Zonyl®FS-300 is a surfactant available from DuPont.
- Silwet®L7605 is Polydimethylsiloxane methylethoxylate available from Momentive Inc.
- Disperal® HP 14 is a alumina nanoparticles manufactured by Sasol Co.
- Zonyl®FSO is a fluoropolymer available from DuPont.
- Aerosil®200 is fumed silica available from Evonik.
- Rovene®4040 is polyacrylic latex available from Mallard Creek Polymers.
- BYK®024 is a surfactant available from BYK Inc.
- A301 is an organosilane available from Onichem.
- Zonyl®FSN100 is surfactant available from DuPont.

Example 1

Supporting Substrate (110)

A supporting substrate (110*a*) is made in a pilot paper machine with a pulp containing about 70 wt % of cellulose fibers, about 22 wt % of inorganic fillers and about 8 wt % of processing additives (including PH and retention control agent; alkyl ketene dimer (AKD) as internal sizing agent; cationic starch as wet strength agent; cationic polyacrylamide as retention control agent; and other functional chemicals, such as colorant (basic dyes) and di-sulfonated optical brightness agent). The cellulose fiber contains about 80 wt % of hardwood and about 20 wt % of softwood. The filler composition contains about 80% of precipitated calcium carbonate and about 20 wt % of $TiO_2$ in the pulp furnish. The basis weight of the supporting substrate (110*a*) is 220 gsm.

A supporting substrate (110*b*) is made in a pilot paper machine with a pulp containing about 42 wt % of cellulose fibers, about 14 wt % of inorganic fillers, about 38 wt % of polyethylene synthetic fibers, about 0.5% nonionic ethoxylated fluoropolymer (Zonyl®FSO) and polyethylene-oxide mixture (10:1) of cellulose fibers by weight, and about 6 wt % of processing additives (including PH and retention control agent; alkyl ketene dimer (AKD) as internal sizing agent; cationic starch as wet strength agent; cationic polyacrylamide as retention control agent; and other functional chemicals, such as colorant (basic dyes) and di-sulfonated optical brightness agent). The cellulose fiber contains about 80 wt % of hardwood and about 20 wt % of softwood. The filler composition contains about 80% of precipitated calcium carbonate and about 20 wt % of $TiO_2$ in the pulp furnish. The basis weight of the supporting substrate (110*b*) is 205 gsm. Such supporting substrate (110*b*) encompasses a hydrophobic layer that is mixed into the fiber furnish in wet end of substrate making.

Example 2

Hydrophobic Layer (120)

A hydrophobic layer (120) is prepared in view of being applied on the supporting base substrate (110). The coating is carried out using a lab rod coater. A self-crosslinkable polymeric hydrophobic substance in an emulsion form (VAPC T330®C), is applied at a dosage of 0.5 to 1 gsm/side on both sides of the substrate, and dried at a temperature of about 95° C. to about 120° C. To obtain the right coat-weight, the polymer emulsion is pre-diluted to a 15-20 wt % solid content. An amphiphile substance, polyethylene-oxide (from Aldrich), in a ratio of 1:8 to the hydrophobic substance, is added into the polymer emulsion to achieve optimized coating effect.

Example 3

Ink Vehicle-Receiving Layer (130)

Table A and B below illustrates different formulations used for making the ink vehicle-receiving layer composition (130). The ink vehicle-receiving layer (130) is either an ink vehicle-receiving layer with bimodal pore size distribution (130*a*), such as illustrated in table A, or an ink vehicle-receiving layer with two distinct structures (130*b*), such as illustrated in table B. All amounts are expressed as parts by weight based on the total weight of the composition.

An ink vehicle-receiving layer composition with bimodal pore size distribution (130*a*) is made by using charge reversed clay and other ingredients according to the formulation listed in TABLE A below. The calcined clay (Ansilex®93) is treated with a reversing charge agent (3-Aminopropyltriethoxysilane) in view of obtaining a reversed charged clay having a Z-potential of 21.8 mV. A block copolymer surfactant (Pluronic®L62) is added to adjust surface tension. The ratio calcined clay/surfactant/reversing charge agent is 100/0.5/5. The mixing is carried at room temperature using a blade mixer for 15 min. The formulation of the coating composition with bimodal pore size distribution (130*a*) is illustrated in table A below. All numbers are parts by weight.

TABLE A

| ink vehicle-receiving layer (130a) | Amount by weight parts |
|---|---|
| Reversed charged clay | 100 |
| Aerosil ® 200 (at 30 wt %) | 35.00 |
| $CaCl_2$ | 5.00 |
| Mowiol ® 40-88 | 15.00 |

An ink vehicle-receiving layer with a two-layer structure (130*b*) is prepared in accordance with the formula as illustrated in the TABLE B below. The ink vehicle-receiving layer (130*b*) encompass a first structure (131*b*), with inorganic particles and binder, and a second structure (132*b*) with nanoporous particles and binder. All amounts are expressed as parts by weight based on the total weight of the composition.

TABLE B

| Ink vehicle-receiving layer (130b) | | Amount by weight parts |
|---|---|---|
| 1st Structure (131b) | Ansilex ® 93 | 40 |
| | Opercarb ® A40 | 60 |
| | Rovene ® 4040 | 15 |
| | BYK ® 024 | 3 |
| | Plumoic ® L61 | 4 |
| | Coat weight (gsm) | 15 |
| | Average pore size (nm) | 140 |
| 2nd structure (132b) | Aerosil ® 200 | 100 |
| | Organosilane A301 | 0.75 |
| | Mowiol ® 4088 | 18 |
| | Glycerol | 0.5 |
| | Silwet ® L7605 | 1 |
| | Coat weight (gsm) | 10 |
| | Average pore size (nm) | 35 |

Example 4

Ink Colorant-Receiving Layer (140)

An ink colorant-receiving layer (140) is prepared in accordance with the formula such as illustrated in the TABLE C below. High refractive alumina nano-particles (Disperal®HP-14) are treated using acetic acid and potassium chloride (ratio by weight 74/1.7/0.08) using a high shear Silverson mixer at 11,000 rpm for about 40 min. The final solids content of the dispersion is 33% at a pH of 4.1. The dispersion is then formulated into the coating composition (140) according to ratio listed in the TABLE C using a blade mixer at 50° C. with very slow agitation to avoid air bubbling. All numbers are expressed in parts per weight based on the total weight of the composition.

TABLE C

| Ink colorant-receiving layer (140) | parts per weight |
|---|---|
| Disperal ® HP-14 (33 wt %) | 19 |
| Mowiol ® 4088 | 2.8 |
| Zonyl ® FSN 100 | 0.1 |
| Silwet ® L7605 | 0.05 |
| Average pore size (nm) | 17 nm |

Example 5

Printable Recording Media

Printable recording media (a) to (f) are prepared: printable recording media (a) to (e) are according to the present disclosure, printable recording media (f) is a comparative example.

The ink vehicle-receiving layer (130), having the formulations (130*a*) or (130*b*) as illustrated in TABLE A or B, are applied on the image side of the media, over the hydrophobic layer (120) or over the supporting substrate when the hydrophobic layer is included in it. The layers are applied using a pilot coater equipped with blade or slot die device (lab Dow coater). The roll is dried and further calendared using a lab calendaring machine under pressure (3000 PSI) and a temperature of 200° F.

The ink colorant-receiving layer (140), having the formulation as illustrated in TABLE C, is applied over the ink vehicle receiving layer (130*a*) or (130*b*) with a slot die coater, in view of obtaining the recording media (a) to (f). The structure of the recording media (a) to (f) with different coat weights, are illustrated in the TABLE D below.

TABLE D

| Recording media structure: | (a) | (b) | (c) | (d) | (e) | (f) comp. |
|---|---|---|---|---|---|---|
| Supporting substrate | | | | | | |
| (110a) | 220 gsm | 220 gsm | 220 gsm | 220 gsm | — | 220 gsm |
| (110b) | — | — | — | — | 205 gsm | — |
| Hydrophobic layer (120) | 5 gsm | 5 gsm | 5 gsm | 5 gsm | 5 gsm | — |
| Ink vehicle-receiving layer | | | | | | |
| (130a) | 20 gsm | 20 gsm | 20 gsm | — | 20 gsm | 20 gsm |
| (130b) | — | — | — | 20 gsm | — | — |
| Ink colorant-receiving layer (140) | 2.0 gsm | 2.7 gsm | 7.6 gsm | 7.6 gsm | 5.1 gsm | 2.0 gsm |

Example 6

Printable Recording Material Performances

Ink composition is prepared based on a dispersion containing $Fe_3O_4$ nanoparticles. The dispersion is produced by milling nanoparticle $Fe_3O_4$ powder (Inframat Advanced Materials, Manchester, Conn.) in a Ultra Apex Mill® UAM-015 (Kotobuki Industries Co., LTD, Kure, Japan) with a dispersant, Silquest®A1230 at a dispersant/metal oxide particles ratio equal to 0.5. The resulting dispersion contains about 8 wt % of $Fe_3O_4$ particles. The average particle size of the $Fe_3O_4$ particles is about 25 nm, as measured by a Nanotrack® particle size analyzer (Microtrac Corp., Montgomeryville Pa.). The dispersion is used to produce the ink composition α as summarized in the TABLE E below. All numbers expressed the percentage per weight of each ingredients based on the total weight of the ink composition.

TABLE E

| Ink Formulation | α |
|---|---|
| $Fe_3O_4$ Dispersion (8 wt %) | 24.8 |
| LEG-1 | 5.00 |
| Dantocol ® DHE | — |
| 2-Pyrrolidinone | 9.00 |
| Trizma ® Base | 0.20 |
| Proxel ® GXL | 0.10 |
| Surfynol ® 465 | 0.20 |
| Water | Up to 100% |

Ink composition α, as illustrated in TABLE E, is filled into HP print cartridge #94. Such ink composition is applied on the recording media (a) to (f) using a HP Photosmart 8540 printer (Hewlett Packard, Palo Alto Calif.). The printed articles are produced at ink flux density in the range of about 50 to about 125 pL/300th pixels.

The resulting printed articles are evaluated for their reflectance (R), their visual appearance, the ink load (at peak R), for the bleeding and coalescence performances as well as for moisture intake and for wrinkling effects. The reflectance R, in percentage (%), is the percentage of reflectance on printed square versus the reflectance percentage on un-printed media (measured by a BYK reflectance meter), higher numbers illustrate better reflectance. The ink load at peak R represents the amount of ink necessary to obtain the best reflectance effect (Smaller numbers illustrate better performances). Metallic appearance and printing quality (ink bleed and coalescence) are evaluated visually. The media are also evaluated for their "moisture intake" after being submitted at 30° C. and 80% humidity for 24 hours and for their "media wrinkling" due to moisture absorption. The results are summarized in TABLE F.

TABLE F

| MEDIA | R (%) | Ink load at peak R | Ink bleed/ Coalescence | metalized appearance | Moisture intake | Media wrinkling |
|---|---|---|---|---|---|---|
| (a) | 12.4 | 106.4 pL/300$^{th}$ | no | Moderate | 1.1% | none |
| (b) | 13.3 | 106.4 pL/300$^{th}$ | no | Good | 1.1% | none |
| (c) | 17.2 | 187 pL/300$^{th}$ | no | Excellent | 1.1% | none |
| (d) | 17.2 | 187 pL/300$^{th}$ | no | Excellent | 1.1% | none |
| (e) | 14.6 | 135 pL/300$^{th}$ | no | Excellent | 0.8% | none |
| (f) | 12.4 | 106.4 pL/300$^{th}$ | no | Bad | 6.9% | yes |

The invention claimed is:

1. A printable recording material, comprising:

a. an opaque supporting substrate;

b. a hydrophobic layer comprising a water dispersible hydrophobic polymer;

c. an ink vehicle-receiving layer having a two-layer structure; and d. an ink colorant-receiving layer comprising inorganic particles for receiving a metallic ink.

2. The printable recording material of claim 1 wherein the hydrophobic layer is part of the supporting substrate.

3. The printable recording material of claim 1 wherein the hydrophobic layer is applied over the supporting substrate.

4. The printable recording material of claim 1 wherein the hydrophobic layer comprises a polymeric hydrophobic substance and an amphiphile substance.

5. The printable recording material of claim 1 wherein the hydrophobic layer comprises a self-crosslinkable polymeric hydrophobic substance, in an emulsion form, and, at least, a surfactant.

6. The printable recording material of claim 1 wherein the ink vehicle-receiving layer having a two-layer structure comprises a first structure with inorganic particles and, at least, a binder; and a second structure with nano-porous particles and, at least, a binder.

7. The printable recording material of claim 1 wherein the ink vehicle-receiving layer, having a two-layer structure, comprises a first structure with calcium carbonates or clays as inorganic particles and a second structure with fumed silica, fumed alumina, boehmite or pseudo-boehmite as nano-porous inorganic particles.

8. The printable recording material of claim 1 wherein the ink colorant-receiving layer contains inorganic particles that can be selected from the group consisting of aluminum oxide ($Al_2O_3$), silicon dioxide ($SiO_2$), nanocrystalline boehmite alumina (AIO(OH)) and aluminum phosphate ($AlPO_4$).

9. The printable recording material of claim 1 wherein the opaque supporting substrate comprises inorganic fillers in an amount ranging from about 8 wt. % to about 40 wt. % by total weight of the supporting substrate.

10. A method for making a printable recording material, comprising:

a. providing an opaque supporting substrate;

b. applying a hydrophobic layer; an ink vehicle-receiving layer having a two-layer structure; applying an ink colorant-receiving layer comprising inorganic particles on top of said layers; and c. drying and calendering the layers.

11. A method for producing printed images, comprising:

a. obtaining a printable recording material containing an opaque supporting substrate, a hydrophobic layer; an ink vehicle-receiving layer having a two-layer structure; and an ink colorant-receiving layer comprising inorganic particles;

b. providing an ink composition;

c. applying the ink composition onto said recording material to form a printed image.

12. The method for producing printed images of claim 11 wherein the ink composition is a metalized ink composition that encompasses dispersed metal oxide particles.

13. A printed article obtained according to the method of claim 11, comprising:

a. a printable recording material containing an opaque supporting substrate; a hydrophobic layer; an ink vehicle-receiving layer having a two-layer structure and an ink colorant-receiving layer with inorganic particles;

b. a printed feature applied on top of said printable recording material.

14. The printable recording material of claim 6 wherein the inorganic particles of the first structure are inorganic pigments having an average particle size ranging from about 0.1 μm to about 1 μm an average pore size ranging from about 70 nm to about 250 nm, and a thickness ranging from about 3 μm to about 25 μm.

15. The printable recording material of claim 14 wherein the nano-porous particles of the second structure have an average pore size that is smaller than the average pore size of the first structure and a thickness ranging from about 0.3 μm to about 15 μm.

16. The printable recording material of claim 1 wherein the inorganic particles forming the ink colorant-receiving layer have a refractive index of 1.65 or more.

* * * * *